US005109910A

United States Patent [19]

Tortorella et al.

[11] Patent Number: 5,109,910

[45] Date of Patent: May 5, 1992

[54] VERTICAL CURTAIN PANEL ASSEMBLY

[76] Inventors: Osmar Tortorella; Yolanda Tortorella, both of 10521 SW. 157th Pl., Apt. No. 108, Miami, Fla. 33196

[21] Appl. No.: 760,682

[22] Filed: Sep. 16, 1991

[51] Int. Cl.[5] ..... E05D 15/06

[52] U.S. Cl. ..... 160/197; 160/202; 160/900

[58] Field of Search ..... 160/166.1, 196.1, 201, 160/168.1, 173, 197, 202, 113, 118, 900; 16/87.4 R, 95 D, 96 D, 94 D, 87 B

[56] References Cited

U.S. PATENT DOCUMENTS 1,960,860 5/1934 Allen ..... 160/196.1 X
2,833,346 5/1958 Preston ..... 160/197
2,850,089 9/1958 Burke ..... 160/202
2,895,183 7/1959 Dumbolton ..... 160/197
2,908,051 10/1959 Sparkes ..... 160/202 X
3,262,488 7/1966 Rieder ..... 160/202
3,348,603 10/1967 Ford ..... 160/202 X
3,574,887 4/1971 Schindlauer ..... 16/95 D
3,911,991 10/1975 Malferrari ..... 160/202

*Primary Examiner*—David M. Purol
*Attorney, Agent, or Firm*—Malloy, Downey & Malloy

[57] ABSTRACT

A vertical curtain panel assembly, to be used to cover windows, sliding glass doors, etc. with a plurality of large, wide, highly decorative panels. The panel assembly includes a plurality of interconnectable frame units having a plurality of channels with movable carriers positioned therein, and disposed such that by utilizing a single draw string attached to a single carrier, the plurality of carriers having decorative panels extending therefrom, may be readily moved between an opened position, wherein all the panels are concealed behind an outermost fixed panel, and a closed window covering position, wherein each panel is exposed and covers a designated area.

7 Claims, 5 Drawing Sheets

VERTICAL CURTAIN PANEL ASSEMBLY

BACKGROUND OF THE INVENTION

1. Field of the Invention

This invention relates to a vertical curtain panel assembly adapted to be utilized to decoratively cover windows, glass sliding doors, etc., with wide decorative panels which may be easily positioned between an opened and closed position without entanglement with one another, thereby providing the user with an attractive, easily utilized, and easily adaptable vertical curtain assembly.

2. Description of the Prior Art

Vertical blinds and like window coverings are becoming a favored and highly utilized means of window and glass door coverings. The most common type of blinds employed utilize a large number of narrow, elongate sections attached along a single track. In order to open and close such assemblies, the individual panels must be reoriented such that they are in a stacked orientation when being opened and closed, using a particularly adapted draw string. The curtains may then be opened and closed using the primary draw string. Although these types of blinds are utilized primarily for their easy use and uniform appearance, numerous difficulties often arise as a result of the large number of sections being attached along a single track. The primary difficulties arise when opening such types of curtains because often when reorienting the sections, an additional and cumbersome task, many of the individual sections are misoriented and must be manually reoriented or the curtain will not open as sections will not stack properly. Further, when closing the curtain, individual sections are often misoriented, thereby detracting from the privacy and uniformity for which the particular type of curtain was installed. Additionally, since all of the sections are attached to one track, when pulling the open/close draw string, a great degree of friction is encountered which makes the curtains difficult to open and close the pulley.

Accordingly, applicant's invention seeks to solve the previously mentioned difficulties through a multi-track, multi-carrier system which may be easily adapted to any desired length, removes the necessity of reorienting the individual panels, and assures easy, low-friction, uniform opening and closing utilizing a single draw string. Further, the wide panels of the applicant's invention, facilitate the employment of a large variety of decorative patterns, while still maintaining quick and easy interchangeability.

SUMMARY OF THE INVENTION

The present invention is directed towards a vertical curtain panel assembly to be used to decoratively cover windows, sliding glass doors, etc. The curtain assembly, which may be sized to cover any size area, includes a plurality of securely and easily interlocking frame units, which attach in a step-like configuration. Each of the individual frame units includes a pair of parallel channels having an upper track and a lower track. Movably disposed within each of said channels is a carrier unit having rolling means to allow easy mobility of the individual carrier along the lower track. Further included on each carrier unit is a wing structure located outside of the channel, which includes a pair of oppositely disposed transverse wings. Each of the wings is designed to engage a correspondingly positioned wing on a carrier in an adjacently positioned channel, thereby causing the moving of a single carrier, through a draw string and pulley means, to position the remaining carriers in a desired opened, closed, or partially opened orientation. Along the bottom edge of each carrier is a panel holder, wherein each individual, decorative, vertical panel may be attached and extends downwardly therefrom.

BRIEF DESCRIPTION OF THE DRAWINGS

For a fuller understanding of the nature of the present invention, reference should be had to the following detail description taken in connection with the accompanying drawings in which.

Like reference numerals refer to like parts throughout the several views of the drawings.

DETAILED DESCRIPTION OF THE PREFERRED EMBODIMENT

Figure 1:
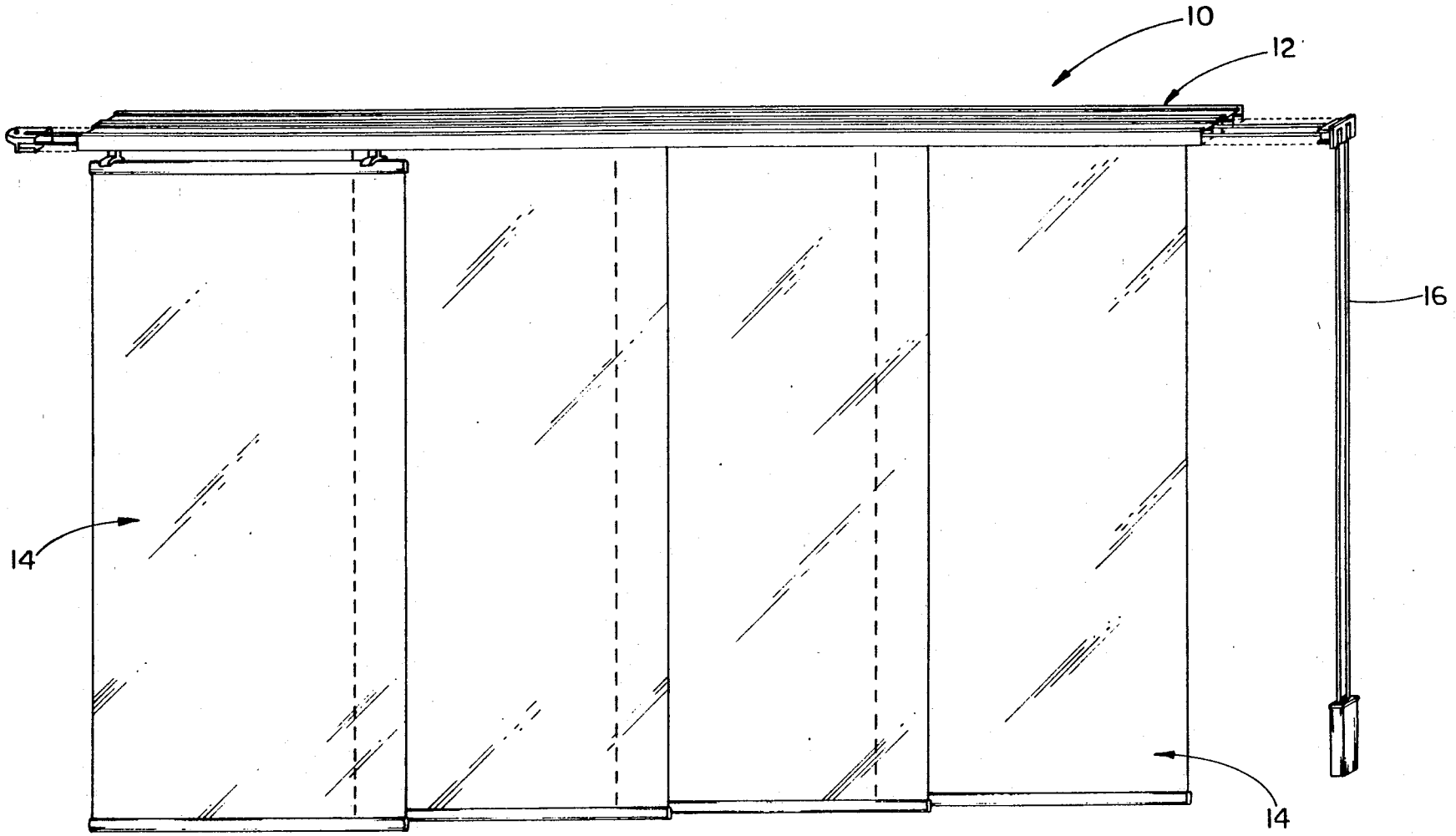
FIG. 1 is a perspective view illustrating the vertical curtain assembly of the present invention.

Referring initially to FIG. 1, the present invention is directed to a vertical curtain assembly generally indicated as 10 including a substantially elongate track frame structure 12 adapted to be mounted to a sealing surface adjacent a window, sliding glass door or across a room for dividing a room into two separate areas.

A plurality of curtain panels 14 are movably attached to the track frame structure 12 and are adapted to be moved therealong by pulling a cord 16 extending from an end of the track frame structure 12. As seen in FIG. 1, the vertical curtain panels 14 are specifically disposed and oriented so as to be movable relative to one another in partially overlapping relation such that when in a closed position, as in FIG. 1, the plurality of curtain panels 14 provide a highly decorative privacy barrier for covering a glass doorway, dividing a room, or for simply providing a decorative backdrop.

Figure 2:
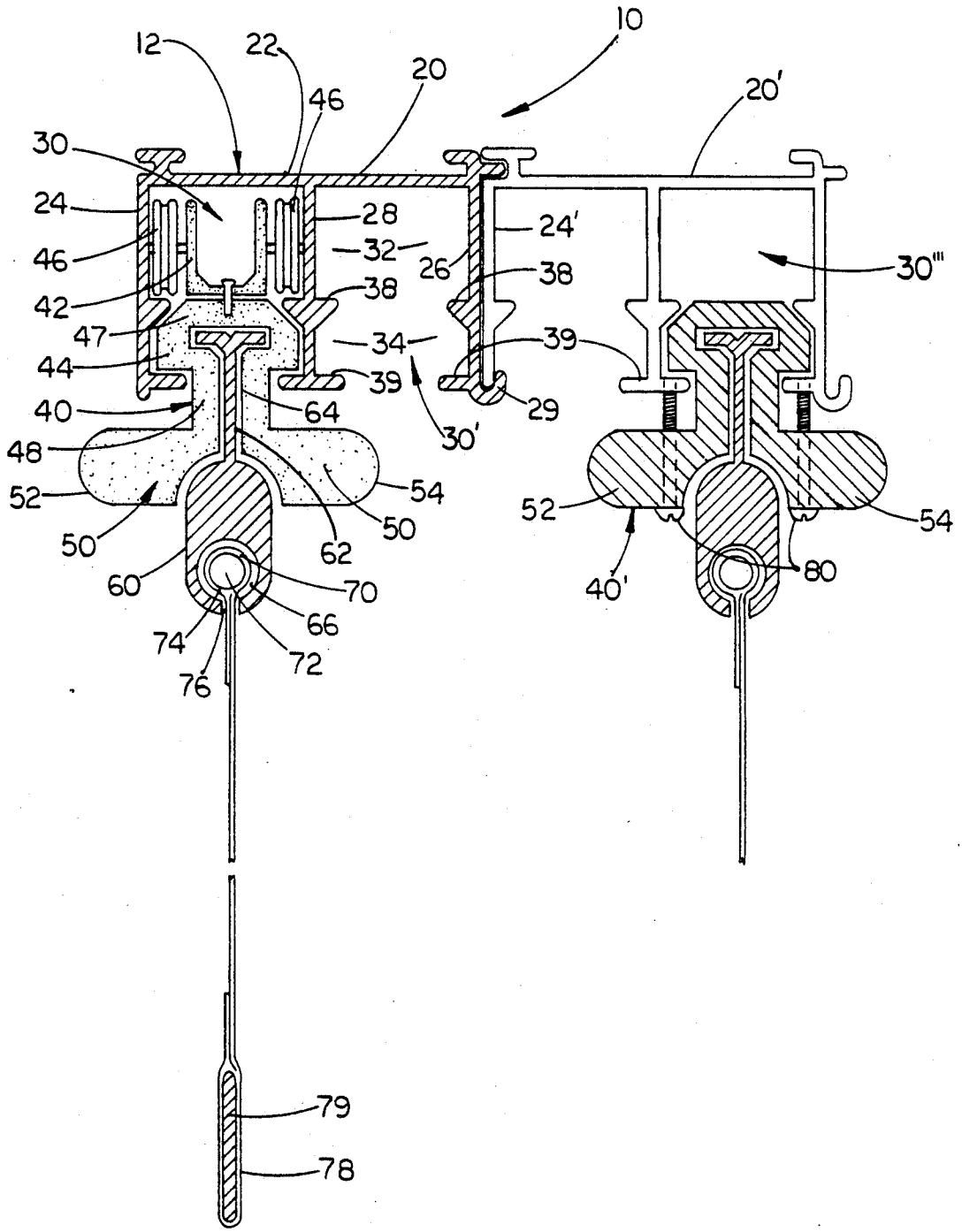
FIG. 2 is a side plan view in partial section illustrating a track frame structure and carrier assembly of the present invention.
Figure 4:
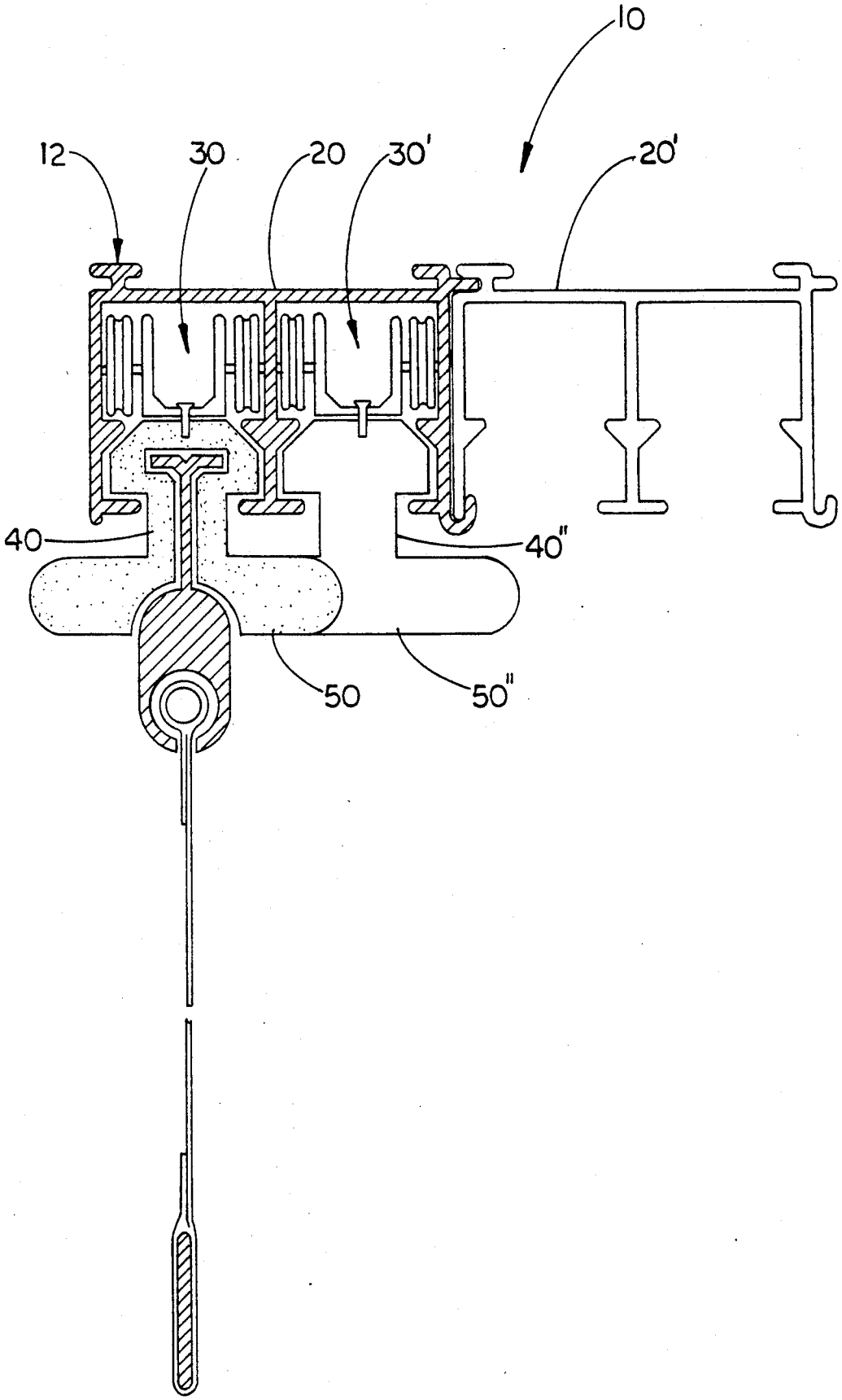
FIG. 4 is a side plan view in partial section illustrating engagement of wings on adjacently disposed carriers in adjacent channels in the track frame structure.

The track frame structure 12 is best illustrated in FIGS. 2 and 4 wherein individual frame units 20, 20' are attachable to one another so as to be disposed in adjacent, parallel relation. Each of the frame units 20, 20' includes a top plate 22, opposite side walls 24 and 26, and a center wall 28 disposed in substantially centered, parallel relation between side walls 24 and 26. Extending substantially along a length of each frame unit 20, 20' are adjacent channels 30, 30' defined between a respective one of the side walls 24, 26 and the center wall 28. Each of the channels 30, 30' include an upper track 32 and a lower track 34 extending along a length thereof. Opposite upper side rails 38 extend inwardly from an inner surface of the side walls 24, 26 along a length of the channel 30, 30' separating the upper track 32 from the lower track 34. Lower side rails 39 extend along a length of the channels 30, 30' along the lower track.

A pair of carriers 40 are fitted within each of the channels 30, 30' for supporting one of the vertical curtain panels 14 so as to facilitate movement along the track frame structure. As seen in FIG. 2, two different types of carriers are used in the present invention including movable carriers 40 and fixed carriers 40'. The movable carriers 40 include an upper portion 42 disposed in the upper track 32 having rollers 46 disposed on opposite sides for engagement with the upper side rails 38. All of the carriers 40, 40' include a lower portion 44 having a head 47 structured and disposed for sliding passage within the lower track 34. The lower portion of the carriers 40, 40' further include a neck 48 which extends downwardly from the head 47 out through an open bottom of the channel 30 and connecting with a wing structure 50. The wing structure includes opposite wings 52, 54 extending transversely outward on opposite sides of the carrier 40, 40'.

An elongate panel holder 60 extends between and is connected near opposite ends to a respective pair of carriers 40 in each of the channels 30, 30'. The elongate panel holder 60 includes a substantially T-shaped portion 62 extending along the length of a top thereof. The T-shaped portion 62 is fitted within a congruently configured slot 64 in the lower portion 44 of the carrier 40, 40' so as to effectively attach and support the panel holder 60 on the respective pair of carriers 40 in each channel 30, 30'. The panel holder 60 further includes an axial bore 66 extending along a length thereof adjacent a lower edge. The axial bore 66 is specifically sized and configured to retain a top edge 70 of a respective curtain panel 14 therein. An elongate rod 72 is fitted within a pocket 74 formed at the top edge in each of the curtain panels 14 which extend downwardly through a slot 76 in the panel holder 60, terminating at a bottom edge 78. The bottom edge 78 is fitted with a substantially rigid, weighted element 79 so as to cause the panels to hang in a preferred vertical orientation while also maintaining a substantially planar configuration.

A pair of fixed carriers 40' are secured in fixed position within a respective one of the channels 30 such that the connected panel holder 60 and curtain panel 14 are not movable along the track frame structure 12. Ordinarily, the fixed pair of carriers 40' are disposed in an outboard most channel 30''' closest to a glass door, window or wall surface along which the vertical curtain assembly is to extend. Each of the fixed carriers 40' are secured within place using screws 80 which extend through opposite wings 52, 54 so as to engage with a outer exposed surface of lower side rails 39 on the frame unit 20'. In this manner, the fixed carriers 40' are locked in place within the respective channel 30'''.

Figure 3:
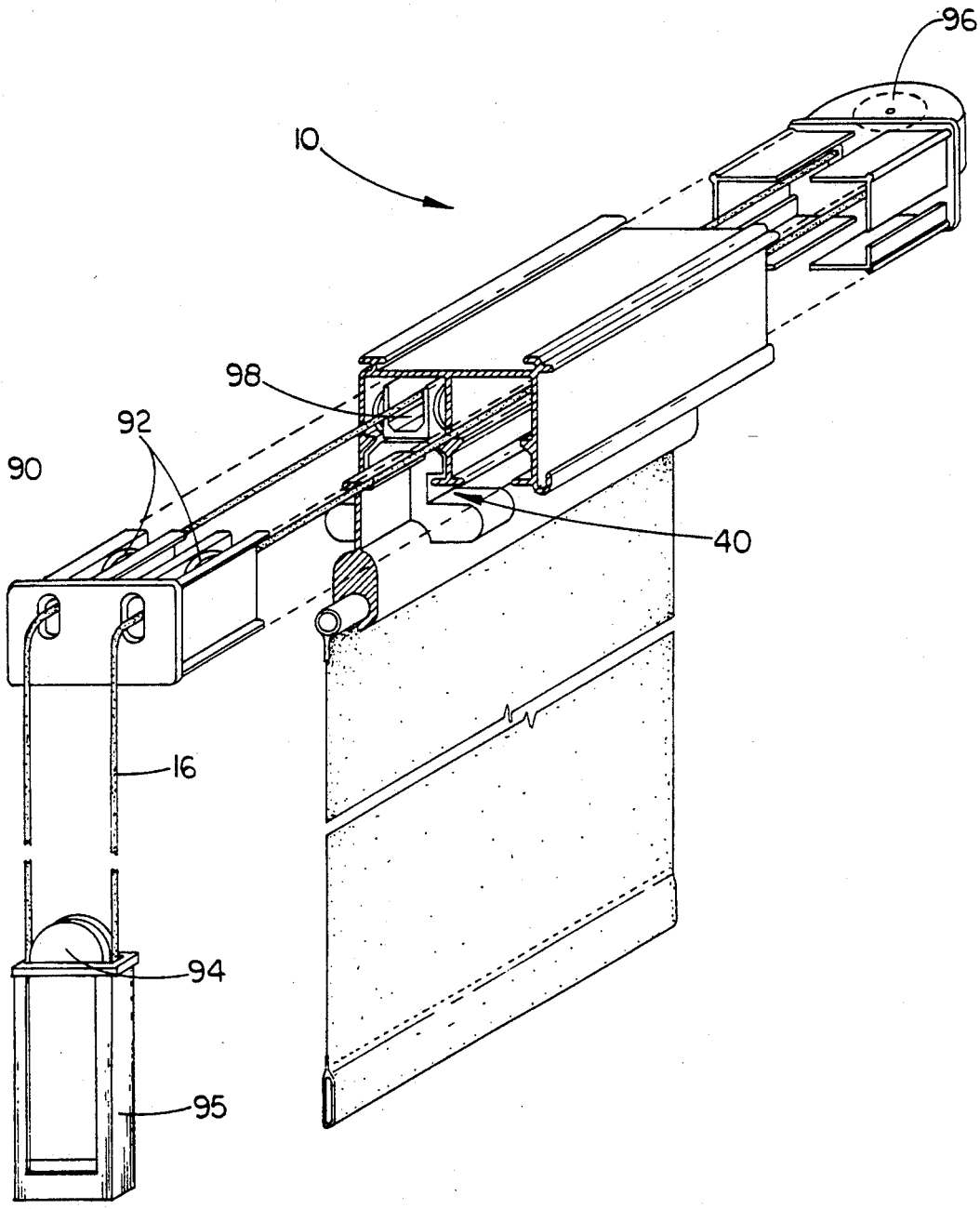
FIG. 3 is an exploded view shown in perspective illustrating interconnection of various components of the vertical curtain assembly of the present invention.

Referring to FIG. 3, the vertical curtain assembly further includes an end cap 90 adapted to be fitted to one end of a frame unit 20. The end cap 90 includes a pair of pulleys 92 therein to guide the pull cord 16 therethrough so as to extend downwardly from an end of the track frame structure. The pull cord 16 passes about a pulley 94 on a counterweight 95 causing the pull cord 16 to hang downwardly in a preferred orientation. Attached to an opposite end of the track frame structure is a pulley cap 96 which guides the pull cord 16 about a continuous loop through the track frame structure 12. Opposite ends of the pull cord 16 are secured to respective ones of a first pair of movable carriers 40, preferably disposed in an inboard-most channel 30.

Figure 5:
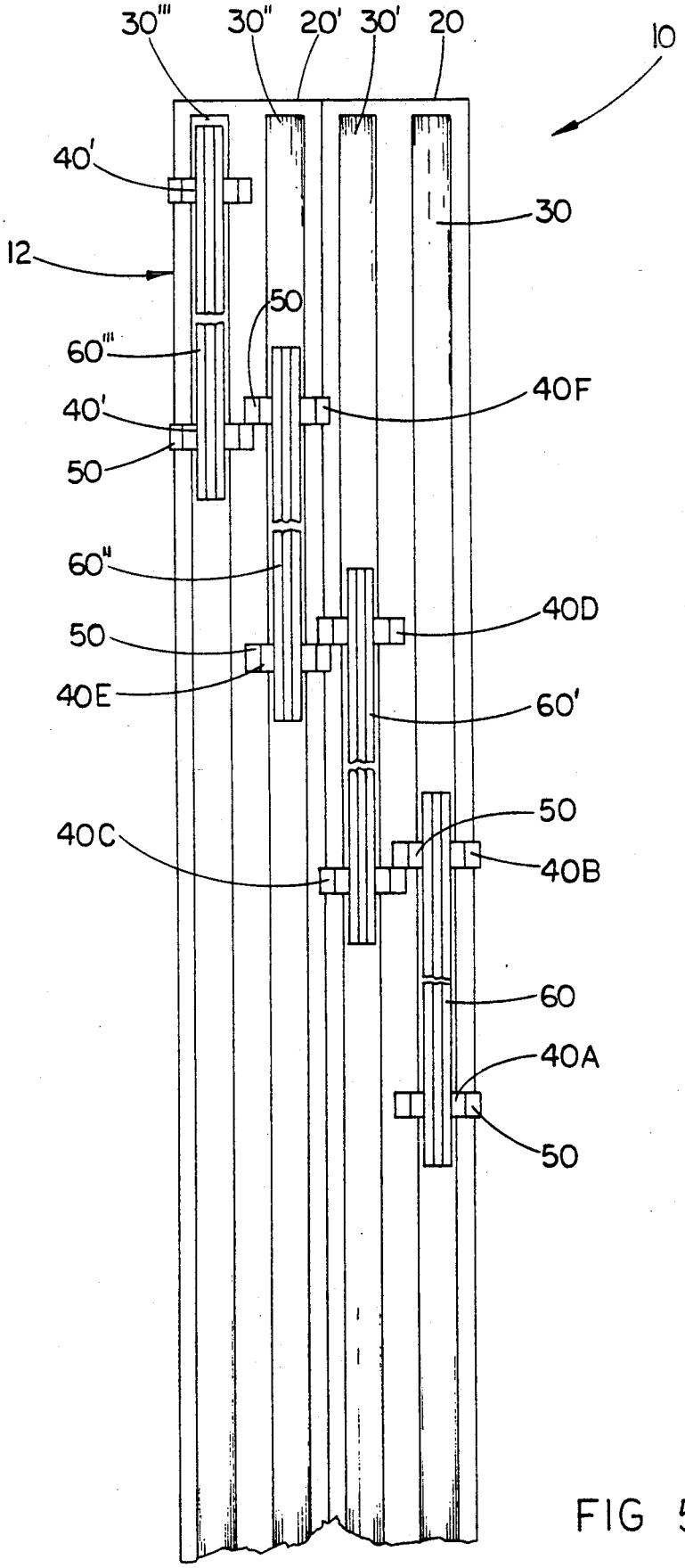
FIG. 5 is a bottom plan view of the track frame structure of the present invention illustrating engagement of the wings on adjacently disposed carriers in adjacent channels facilitating movement of individual curtain panels along respective channels in the track frame structure.

In operation, as the pull cord 16 is manipulated so as to advance the first pair of movable carriers 40 in the inboard-most channel 30, a first one of the curtain panels 14 begins to advance along the track frame structure 12. Eventually, the wing structure 50 on a trailing one of the first pair of movable carriers 40 engages the wing structure of an adjacently positioned carrier 40 in an adjacent channel 30'. This is best illustrated in FIG. 5 wherein the first pair of movable carriers 40A, 40B are movable along channel 30 in frame unit 20 thus carrying panel holder 60 and an attached panel 14 therealong. Eventually, the wing structure 50 on trailing carrier 40B in the first pair engages with the wing structure on a leading carrier 40C in the adjacent channel 30' As the first pair of carriers 40A, 40B, and attached panel holder 60 are continually advanced, the adjacent pair of carriers 40C, 40D and attached panel holder 60' are pulled along channel 30' by virtue of the engagement of the wing structures on carriers 40B and 40C. In a similar manner, eventually the trailing carrier 40D in channel 30' engages a leading carrier 40E in channel 30'' causing the panel holder 60'' to be pulled therealong. When the wing structure 50 on the trailing carrier 40F in channel 30'' engages the wing structure 50 on the fixed carrier 40' an outboard most channel 30''', advancement of the panels 14 is completed and the vertical curtain assembly is fully closed. To open the curtain assembly, the cord 16 is pulled so as to retrieve the first pair of carriers 40A, 40B and attached panel holder 60 and panel 14. When the wing structure 50 on carrier 40A engages the wing structure on carrier 40C, the panel holder 60' and attached panel 14 are pulled along in a similar manner as when closing the curtain assembly. The carriers 40E, 40F and attached panel holder 60' are eventually pulled along channel 30' upon continued retrieval of the first pair of carriers 40A, 40B.

While this invention has been described in what is considered to be a practical and preferred embodiment, it is recognized that departures may be made within the spirit and scope of this invention which is, therefore, not to be limited except as set forth in the claims hereinafter and within the doctrine of equivalents.

Now that the invention has been described,

What is claimed is:

1. A vertical curtain panel assembly for providing a decorative privacy barrier comprising:

an elongate frame structure including at least one frame unit having a top plate, two opposite longitudinal side walls and a longitudinal center wall equally spaced between said opposite side walls in parallel relation thereto, said frame unit further including a pair of channels each defined between a respective of said side walls and said center wall, each of said channels including an upper track and a lower track, means on said side walls for attachment of an adjacent frame unit so as to add adjacent channels to the assembly, a plurality of carriers each structured and disposed for receipt within one of said channels and including one pair of fixed carriers secured within a respective one of said channels and a plurality of movable pairs of carriers, each pair of movable carriers being movably fitted within a respective one of the remaining adjacent channels, roller means on said movable carriers to allow movement thereof along a length of said upper and lower tracks in said channels.

each of said plurality of carriers including a lower portion fitted within said lower track and extending outwardly from an opening along said channels, said carriers each including a wing structure including a pair of oppositely disposed transverse wings extending outwardly from said lower portion of each of said carriers exteriorly of said channels, said wings being structured and disposed to engage corresponding wings on adjacently positioned carriers in the adjacent channels, a plurality of elongate panel holders each connected near opposite ends and extending between one of said respective pairs of said carriers within a respective one of said channels, such that said panel holder is supported in substantially parallel, spaced relation below the channel along a portion of a length thereof, a plurality of vertical panels each attached along a top edge to a respective one of said panel holders and extending downwardly therefrom, and means for pulling a first pair of said movable carriers along the respective channel wherein continued advancement results in engagement of said wing structure on a trailing one of said first pair of movable carriers with the wing structure on a next adjacent leading carrier in a second pair of carriers in the adjacent channel, continued advancement of said carriers terminating upon engagement of the wing structure on said fixed pair of carriers with the wing structure on an adjacent pair of movable carriers.

2. A vertical curtain panel assembly as recited in claim 1 wherein said movable carriers may be drawn to either single side, to both sides, or to a center position.

3. A vertical curtain panel assembly as recited in claim 2 wherein said vertical panels include a decorative pattern thereon.

4. A vertical curtain panel assembly as recited in claim 3 wherein said fixed pair of carriers includes a pair of screws passing through each of said fixed pair of carriers, and engaging a lower portion of said frame unit, thereby preventing mobility.

5. A vertical curtain panel assembly as recited in claim 4 wherein said panel holders includes an axial bore having an axially extending slot along a lower portion thereof, such that an elongate rod located within a pocket formed at a distal end of said vertical panels, may be positioned therein, thereby providing secure positioning of said vertical panels.

6. A vertical curtain panel assembly as recited in claim 5 wherein said means for pulling aforesaid first pair of said movable carriers includes an end cap having a pair of pulleys therein which guide a draw string which is attached at one end to one of said first pair of said movable carriers, and having a second end passing through a pulley cap located at an opposite distal end of said frame unit from s id end cap, and attached to said one of said first pair of said movable carriers, such that said draw string forms a continuous loop.

7. A vertical curtain panel assembly as recited in claim 6 wherein said pull cord passes through a pair of openings in said end cap, and an exposed end of said draw string passes around a weight pulley located within a counterweight.

* * * * *